US006360412B1

(12) United States Patent
Duval et al.

(10) Patent No.: US 6,360,412 B1
(45) Date of Patent: Mar. 26, 2002

(54) METHOD OF MONITORING THE NEEDLING OF FIBER STRUCTURES IN REAL TIME, AND NEEDLING APPARATUS FOR IMPLEMENTING THE METHOD

(75) Inventors: Renaud Duval, Les Cheres; Thierry Marjollet, Besancon; Robert Jean, Fouqueville, all of (FR)

(73) Assignee: Messier-Bugatti, Velizy-Villacoublay (FR)

( * ) Notice: Subject to any disclaimer, the term of this patent is extended or adjusted under 35 U.S.C. 154(b) by 0 days.

(21) Appl. No.: 09/900,276

(22) Filed: Jul. 6, 2001

(30) Foreign Application Priority Data

Jun. 5, 2001 (FR) ..... 01 07299

(51) Int. Cl.[7] ..... D04H 18/00
(52) U.S. Cl. ..... 28/107
(58) Field of Search ..... 28/103, 107, 111, 28/113, 114, 115; 112/80.01, 80.18, 80.23, 80.4, 80.42

(56) References Cited

U.S. PATENT DOCUMENTS 4,891,870 A * 1/1990 Muller ..... 28/107
5,504,979 A * 4/1996 Sheehan et al. ..... 28/107
5,581,857 A * 12/1996 Sheehan et al. ..... 28/107
5,636,420 A * 6/1997 Jourde et al. ..... 28/107
5,740,593 A * 4/1998 Sheehan et al. ..... 28/107
6,029,327 A * 2/2000 Sheehan et al. ..... 28/107
6,237,203 B1 * 5/2001 Sheehan et al. ..... 28/107

* cited by examiner

*Primary Examiner*—Danny Worrell
(74) *Attorney, Agent, or Firm*—Weingarten, Schurgin, Gagnebin & Lebovici LLP

(57) ABSTRACT

A needled fiber structure is made by stacking fiber plies on a platen, by needling the plies as the stack of plies is built up by means of needles driven with reciprocating motion in a direction that extends transversely relative to the plies, and by varying the distance between the platen and an end-of-stroke position of the needles while building up the stack so as to obtain a desired distribution of needling characteristics through the thickness of the fiber structure. The instantaneous force exerted during needle penetration is measured (sensors) and a magnitude representative of needling force or penetration energy is evaluated on the basis of the instantaneous force, and the evaluated magnitude is verified for compliance with at least one predetermined condition to monitor proper operation of the process or to act on the way the distance between the platen and the end-of-stroke position of the needles is varied.

16 Claims, 4 Drawing Sheets

II
112
10
110
114
101
16
18
100
P
12
16
108
108
18
14
106
106
102
104
109
II 116
to 109
113
to 109
112
112
118
110
114
P
108
108
108
100
104
106
102
106
106

112
112
110
114
P
100
106
106
108
108
104
103
103

NEEDLE INITIAL PLIES
40
ADD A NEW PLY
41
PREDETERMINED DOWN STEP SIZE
42
NEEDLE AND MEASURE ENERGY
43
END OF NEEDLING A PLY ?
44
NO
YES
$E_{min} \leq E \leq E_{max}$?
45
YES
NO
ALARM
46

METHOD OF MONITORING THE NEEDLING OF FIBER STRUCTURES IN REAL TIME, AND NEEDLING APPARATUS FOR IMPLEMENTING THE METHOD

BACKGROUND OF THE INVENTION

The invention relates to needling fiber structures, in particular to make preforms for constituting reinforcing structures in composite material parts, e.g. such as preforms for brake disks of thermostructural composite material.

To make such needled structures, it is well known to stack fiber plies on a platen and to needle the plies as they are being stacked by means of needles which are driven with reciprocating motion in a direction that extends transversely relative to the plies (or Z direction).

The needles take fibers from the plies and transfer them in the Z direction. The Z fibers confer cohesion and resistance to delamination (ply separation) to the needled structure. It is thus possible to ensure that composite parts incorporating such structures as fiber reinforcement have mechanical strength enabling them to withstand shear forces, as is necessary for brake disks when applying braking torque.

To confer desired needling characteristics throughout the thickness of the needled fiber structure, it is known to control the distance between the platen and one end of the needle stroke while the stack of plies is being built up. More particularly, document U.S. Pat. No. 4,790,052 proposes increasing this distance each time a new ply is stacked by causing the platen to move down by a step of size equal to the thickness of the needled ply, the purpose being to cause needling density to be uniform throughout the entire thickness of the fiber structure.

Document EP 0 736 115 proposes taking account of variation in the behavior of the fiber structure while it is being built up so that the size of the down steps imparted to the platen varies in compliance with a predetermined decreasing relationship. The purpose is to confer constant thickness to the various layers constituted by the needled-together plies.

Document EP 0 695 823 proposes transferring fibers in the Z direction by controlling needle penetration depth during the needling process. To this end, a magnitude representative of the position of the free surface of the fiber structure being needled is generated by using sensors which measure the position of the free surface outside the needling zone.

Compared with a process in which the size of the down step is predetermined, real time measurement of the position of the surface can make it possible to take account of any drift that may occur relative to a model, e.g. due to variations in the thicknesses of individual plies. Nevertheless, in Document EP 0 695 823, the measurement is not taken exactly in register with the needling. In addition, other kinds of drift are possible relative to the preestablished conditions, and these are not taken into account, for example needle wear.

OBJECT AND SUMMARY OF THE INVENTION

An object of the invention is to provide a needling method that makes it possible to take account of the real effectiveness of the needles throughout the needling process, so as to be able to monitor or control the process in real time.

This object is achieved by a method of making a needled fiber structure of the type comprising stacking fiber plies on a platen, needling the plies together as the stack is built up by means of needles that are driven with reciprocating motion in a direction that extends transversely relative to the plies, and varying the distance between the platen and an end-of-stroke position of the needles while building up the stack so as to obtain a desired distribution of needling characteristics through the thickness of the fiber structure, in which method the instantaneous force (f) exerted during needle penetration is measured and a magnitude representing needling force (F) or penetration energy (E) is evaluated on the basis of the instantaneous force, and the evaluated magnitude (F; E) is verified for compliance with at least one predetermined condition.

The penetration energy (E) of the needles can be evaluated by integrating the measured instantaneous force (f), e.g. over a duration from entry of the needles into the fiber structure and arrival of the needles at the bottom of their stroke.

The evaluated magnitude can also be the maximum value (F) of the instantaneous needling force (f) as measured during penetration of the needles in the fiber structure.

Depending on the distribution desired for needling characteristics in the thickness of the fiber structure, it is verified that the magnitude representative of the needling force (F) or of the penetration energy (E) remains substantially constant, or complies substantially with a preestablished variation relationship.

In an aspect of the invention, the measured needling force (F) or penetration energy (E) provides means for monitoring proper operation of the needling, and needling is controlled in application of a predefined process, e.g. a platen down step of constant size, or a particular variation in the size of the down step as in document EP 0 736 115.

In another aspect of the invention, variation in the distance between the platen and an end-of-stroke position of the needles is controlled as a function of the evaluated value for the needling force (F) or the penetration energy (E).

In particular, when the distance between the platen and an end-of-stroke position of the needles is caused to vary in predetermined manner during the needling process, and when the evaluated magnitude (E) or (F) does not satisfy a predetermined condition, an additional modification of said distance is superposed on said variation, where appropriate.

In this aspect, variation in distance is servo-controlled so as to maintain the needling force or the penetration energy of the needles at a predetermined value or so as to comply with a predetermined variation relationship, depending on the distribution desired for the needling characteristics through the thickness of the fiber structure, and in particular the characteristic of Z fiber density.

In both aspects of the invention, measuring the force exerted or the energy expended during penetration of the needles makes it possible to take account of the real effectiveness of the needles and to integrate any variation, e.g. the individual thickness of an irregular ply or premature wear of the needles.

The instantaneous penetration force (f) is advantageously measured on the platen.

The invention also provides needling apparatus enabling the above methods to be implemented.

This object is achieved by means of apparatus comprising a platen on which fiber plies can be stacked, a plurality of needles carried by a support above the platen, drive means for driving the needle support so as to impart reciprocating motion to the needles in a direction that extends transversely relative to the platen, and means for varying the distance between the platen and an end-of-stroke position of the needles, which apparatus includes at least one force sensor suitable for delivering a signal representative of the instantaneous force exerted during penetration of the needles into the fiber plies stacked on the platen.

BRIEF DESCRIPTION OF THE DRAWINGS

The invention will be better understood on reading the following description given by way of non-limiting indication and with reference to the accompanying drawings, in which.

DETAILED DESCRIPTION OF EMBODIMENTS

Figure 1:
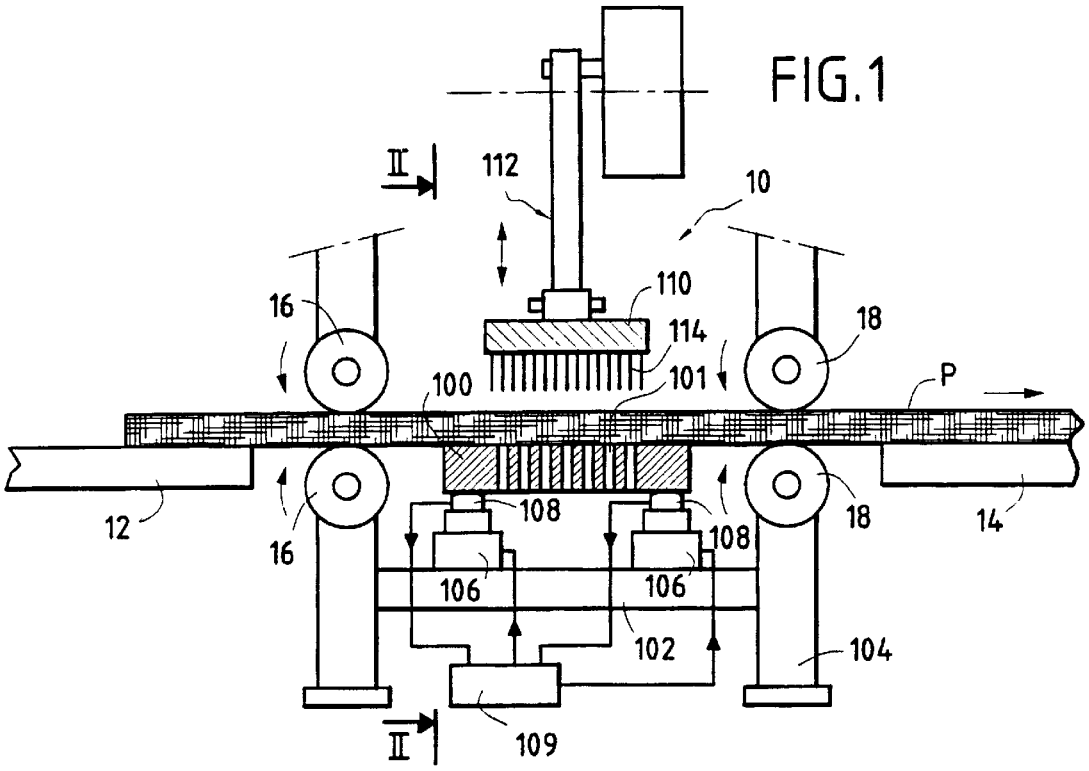
FIG. 1 is a diagrammatic elevation view of rectilinear needling apparatus in accordance with the invention.
Figure 2:
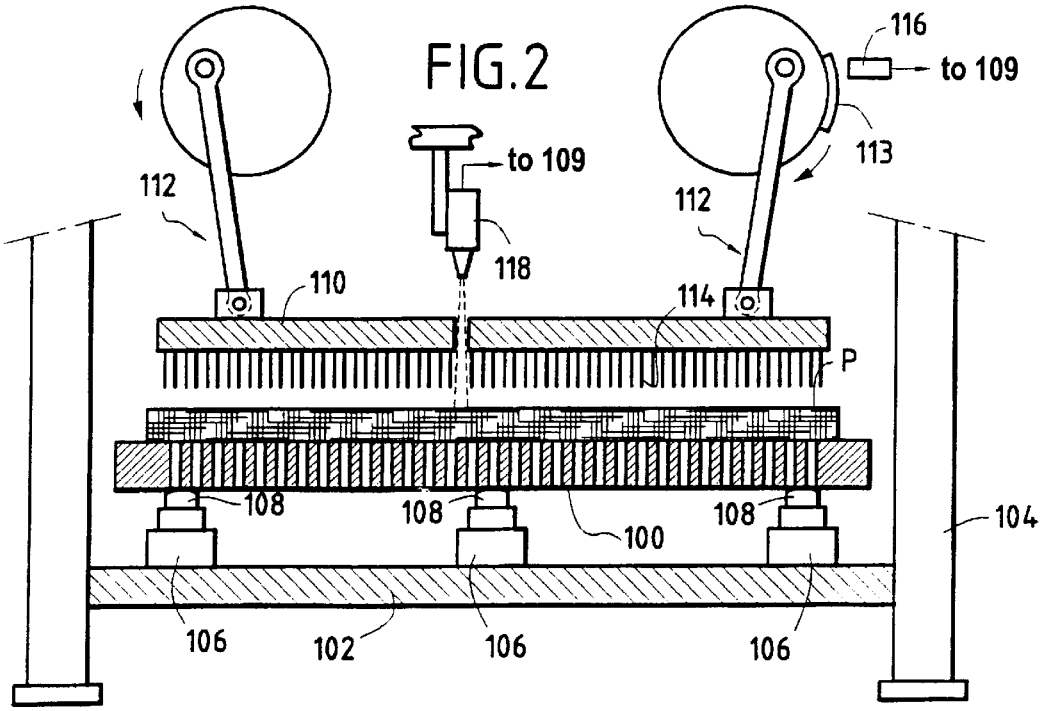
FIG. 2 is a diagrammatic view in elevation and in section on plane II—II of FIG. 1.

FIGS. 1 and 2 are diagrams showing a rectilinear needling installation comprising, in well known manner, a needling station 10 placed between a first table 12 and a second table 14.

Presser-roller drive systems 16, 18 are interposed between the table 12 and the needling station 10 and between the needling station and the table 14.

A fiber plate P is moved with reciprocating motion in rectilinear translation between the tables 12 and 14 through the needling station 10. The plate P is made of fiber plies which are stacked and which are needled together as the stack is built up. The plies can be constituted by woven cloth, unidirectional or multidirectional sheets, knits, felts, or other essentially two-dimensional fiber fabrics. After each needling pass, once the plate P has passed right through the needling station 10 and reached one of the tables 12 and 14, a new ply is added, and a new needling pass is performed by moving the plate in the opposite direction.

In the needling station 10, the plate P passes over a support platen 100 having a needle board 110 placed above it.

The support platen 100 rests on beams 102 of a support structure 104 via actuators 106, e.g. six such actuators, serving to vary the vertical position of the platen 100.

The needle board 110 extends transversely relative to the travel direction of the plate P, at least over the entire width thereof. The board 110 is driven with reciprocating motion in vertical translation by means of one or more crank-and-connecting-rod type drive devices 112. In the example shown, two crank systems are provided, connected to the board in the vicinity of its ends. One or more motors (not shown), e.g. carried by the support structure 104, drive the crank systems 112.

The needles 114 carried by the board 110 are provided with barbs, hooks, or forks. They penetrate into the fiber fabric of the plies making up the plate P so as to take fibers therefrom, which fibers are moved transversely relative to the plies (Z direction), and bind the plies together.

A needling pass is performed after a new fiber ply has been added, by causing the plate P to advance by means of the presser rollers 16, 18 so that the needles sweep over the entire surface of the plate. The plate can advance continuously or otherwise. If not advancing continuously, the plate can be stopped or slowed down while the needles are penetrating.

The actuators 106 are controlled to move the platen 100 so that the distance between the platen 100 and one end of the stroke of the needles 114 can be varied.

The penetration depth of the needles 114 in the plate P extends through several thicknesses of plies. Holes 101 are formed in the platen 100 in register with the needles 114 so that the needles can penetrate therein while needling the initial plies. Apparatus of the type described above is well known. Reference can be made in particular to above-cited document U.S. Pat. No. 4,790,052.

In accordance with the invention, one or more force sensors are disposed in such a manner as to provide a signal representative of the force exerted during penetration of the needles into the plate P.

Although forces can be measured via the needle board, for greater convenience and in order to avoid interference from the acceleration and vibration to which the needle board is subject, force is preferably measured via the platen 100.

In the example shown in FIGS. 1 and 2, force sensors 108 are interposed between the rods of the actuators 106 and the platen 100. In conventional manner, the sensors 108 can be strain gauges, e.g. of the piezoelectric type, connected in a bridge configuration. The electrical signals from the sensors 108 are received by a circuit 109 (FIG. 1). The circuit 109 is a control circuit which serves, in particular, to deliver control signals to the drive systems 16, 18 and to the actuators 106.

The signals supplied by the sensors 108 represent the instantaneous needle penetration force. The signals received from the various sensors can be summed or averaged in order to provide a mean signal f' from which a value f can be generated that is representative of the instantaneous penetration force.

While the needles are not in the plate, a non-zero mean force $f'_0$ can be provided by the signals from the sensors, because of the residual forces acting on the platen, e.g. due to friction between the plate and a stripper (not shown) pressed against it. The force $f'_0$ is measured, for example, when passing through top dead-center where the residual forces (voluntary or otherwise) due to friction between the stripper and the preform are at a minimum. The value f representative of the instantaneous needling force or penetration force proper is then equal to $f'-f'_0$.

A magnitude F representative of the needling force during each penetration of the needles can be obtained by taking the maximum of the instantaneous force f as measured during said penetration.

To this end, the value f is sampled by the circuit 109 and the magnitude F used is the value of the sample having the maximum amplitude measured during each stroke of the needles. The beginning of each needle penetration cycle can be fixed by their passage thorough the top dead-center point of their stroke. This is detected by means of a sensor 116, e.g. of the optical or inductive type that co-operates, for example, with a cam profile 113 having an angular position corresponding to top dead-center and constrained to rotate with the crank of one of the drive systems 112 for the needle board. Signals from the sensor 116 are received and processed by the circuit 109.

In a variant, it is preferable to generate a magnitude E representative of needle penetration energy, which can be correlated with the quantity of fibers transferred in the Z direction. This magnitude E is obtained by using the circuit 109 to integrate the measured instantaneous penetration force f with respect to time.

This integration of the value f is performed over a predefined period, e.g. the time taken by the needles to go from top dead-center to bottom dead-center of their stroke.

Passage through bottom dead-center can be detected in the same manner as passage through top dead-center.

It is possible to start integration of the value f not while passing through top dead-center, but at the moment the needles penetrate into the fiber plate. To detect this moment, it is possible to measure the instantaneous position of the top face of the fiber plate. The duration of a cycle between two successive passes through top dead-center can be determined by detecting said passes, given that the stroke of the needles is constant and known, so knowledge concerning the position of the top face of the fiber plate between top and bottom dead-centers makes it possible to determine the instant within the cycle at which the needles penetrate into the fiber plate.

Mechanical means in the form of feelers serve to measure the position of the top face of the fiber plate, as described in above-cited document EP 0 695 823.

It is also possible, advantageously, to use contactless optical measuring means such as a laser emitter/receiver unit 118 as described in the Assignee's French patent application No. FR 01/02869. The emitter occupies a position that is fixed relative to the support structure 104 and it directs a laser beam towards the surface of the fiber plate. The preferably non-collimated laser beam is reflected and by analyzing the beam pass between the emitter and the receiver it is possible to provide the desired position information. The emitter/receiver 118 is connected to the circuit 109 and can be positioned in the needling station so that the laser beam passes through an orifice formed in the needle board 110.

Figure 3:
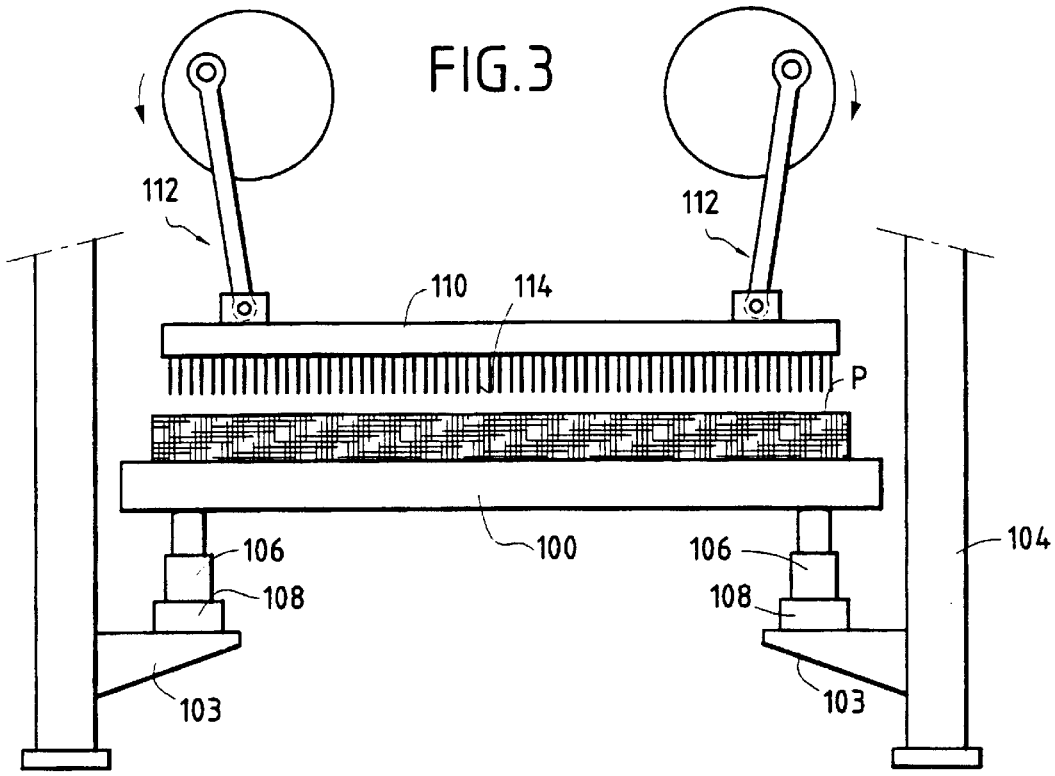
FIG. 3 is a diagrammatic view in elevation and in section showing a variant embodiment of rectilinear needling apparatus in accordance with the invention.

The embodiment of FIG. 3 differs from that of FIG. 2 in that the platen 100 of the needling station is pressed via four actuators 106 on brackets 103 that are carried by columns of the support structure 104.

In this case, the force sensors 108 are interposed between the brackets 103 and the cylinders of the actuators 106. A similar disposition of the sensors could be adopted in the embodiment of FIGS. 1 and 2.

Compared with the installation of FIGS. 1 and 2, the FIG. 3 installation can be more appropriate for needling plates P of smaller widths.

A needling process constituting an implementation of the invention is described below with reference to FIG. 4.

Optionally after needling a few initial superposed plies (step 40), a new ply is added (step 41), and the platen is caused to move down one step (step 42).

The size of the down step is predetermined. During the needling process, the down step imparted to the platen after each pass during which a ply is needled and a new ply is superposed can be constant or it can vary in predetermined manner, as described in above-cited documents U.S. Pat. No. 4,790,052 and EP 0 736 115.

While needling a superposed ply, the needling force F due to the needles penetrating into the fiber structure or the penetration energy E of the needles is/are evaluated by means of the sensors 106 and the circuit 109 (step 43).

The magnitude of the force F or of the energy E as evaluated can be that which is determined on each penetration of the needles, or it is possible to average the force measurements made during a plurality of successive needle penetrations.

In the description below of various implementations of a needling process, particular attention is given to evaluating needle penetration energy E, which can be correlated with the quantity of fibers transferred in the Z direction. These processes could, in similar manner, be implemented with the needling force being measured, which is representative of the real effectiveness of the needles.

Figure 4:
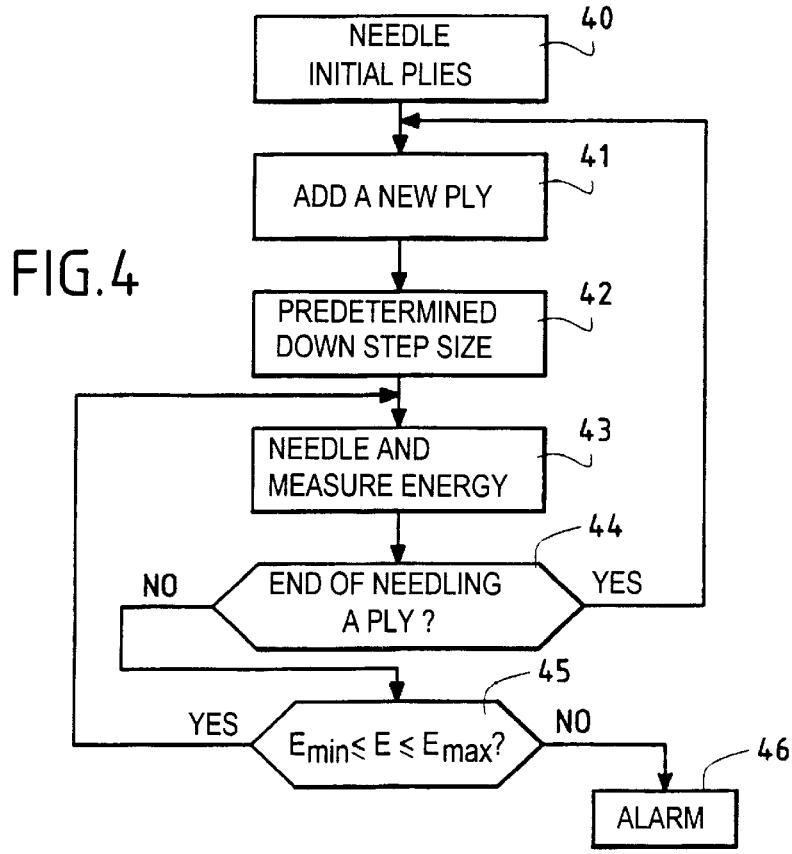
FIGS. 4 to 6 are flow charts showing successive steps in three implementations of a method of the invention.

In the implementation of FIG. 4, if the present needling pass has not terminated (test 44) then the evaluated penetration energy E is compared with a minimum threshold value $E_{min}$ and a maximum threshold value $E_{max}$. If E lies in the range $[E_{min}, E_{max}]$ (test 45), then the method returns to step 43. If test 44 shows that the needling pass has terminated (which can be detected by an end-of-stroke sensor for the plate P), then the method returns to step 41.

If the outcome of test 45 is negative, then an alarm signal is produced (step 46) indicating that the needling force, and thus the effectiveness of the needles, no longer lies within a predetermined tolerance range. This can be due, for example, to wear, to a needle breaking, to the table being wrongly positioned, or to the needled product or the plies making up the plate P behaving in a non-standard way.

The values $E_{min}$ and $E_{max}$ are determined experimentally, in particular as a function of the desired needling characteristics, in particular the density of Z fibers. The values $E_{min}$ and $E_{max}$ can be fixed, or they vary as the plate P is built up so as to follow a predetermined variation relationship. Thus, for example, penetration energy and therefore Z fiber density can be greater in those portions of the plate in which it is desired to obtain a larger density of Z fibers in order to increase resistance to delamination.

By continuously measuring penetration energy, the process of FIG. 4 makes it possible to verify that needling is being carried out with real effectiveness that corresponds to that desired.

A needling process constituting another implementation of the invention is described below with reference to FIG. 5.

This process comprises steps 50 to 53 of needling initial plies, adding a new ply, implementing a down step of predetermined size, and needling and measuring penetration energy that are analogous to the steps 40 to 43 of the process of FIG. 4.

The evaluated energy E is compared with predetermined minimum and maximum values $E'_{min}$ and $E'_{max}$ providing the current needling pass has not terminated (test 54).

When the evaluated energy becomes greater than the threshold $E'_{max}$ (test 55), a down increment Dh is applied to the platen 100 (step 56). This can be performed while needling the last stacked ply, as soon as it is detected that the threshold has been passed, or at the end of needling the ply, with the increment Dh being superposed on the predetermined down step size. After step 55, the process returns to step 53. If during the test 54, it is found that the present needling pass has terminated, then it returns to step 51 for adding a new ply.

When the outcome of test 55 is negative, the evaluated energy E is compared with the threshold $E'_{min}$. If the evaluated energy is less than the threshold $E'_{min}$ (test 57), then an up increment D'h, e.g. opposite to Dh, is imparted to the platen 100 (step 58) immediately or at the end of the current needling pass, with the increment D'h being superposed on the predetermined down step size. After step 58, the process moves back to step 53.

The thresholds $E'_{min}$ and $E'_{max}$ can be determined experimentally and they are not necessarily equal to those of the process of FIG. 4. They can be fixed or variable in predetermined manner as the needled plate is built up.

By way of example, the increments Dh and D'h can be in the range one to a few percent of the mean down step size.

It will be observed that the increments Dh and D'h can themselves be variable, e.g. as a function of the extent to which the thresholds $E'_{min}$ or $E'_{max}$ are exceeded.

Figure 5:
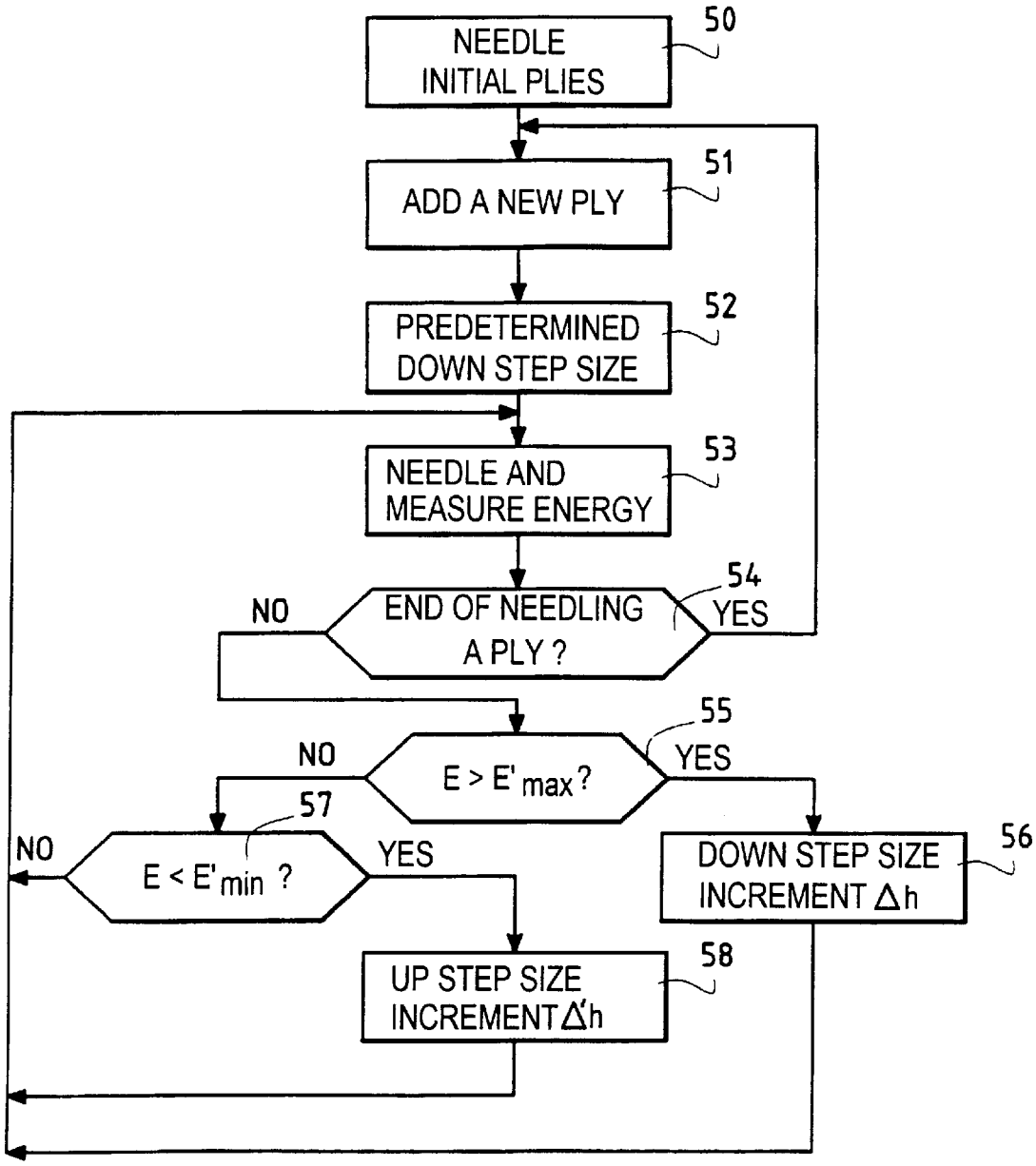

By continuously measuring the needling force, the process of FIG. 5 makes it possible, where appropriate, to correct the predetermined value of the down step size, or to correct a predetermined relationship for varying the down step size, so as to ensure that the effectiveness of the needles remains in compliance with the expected effectiveness.

Figure 6:
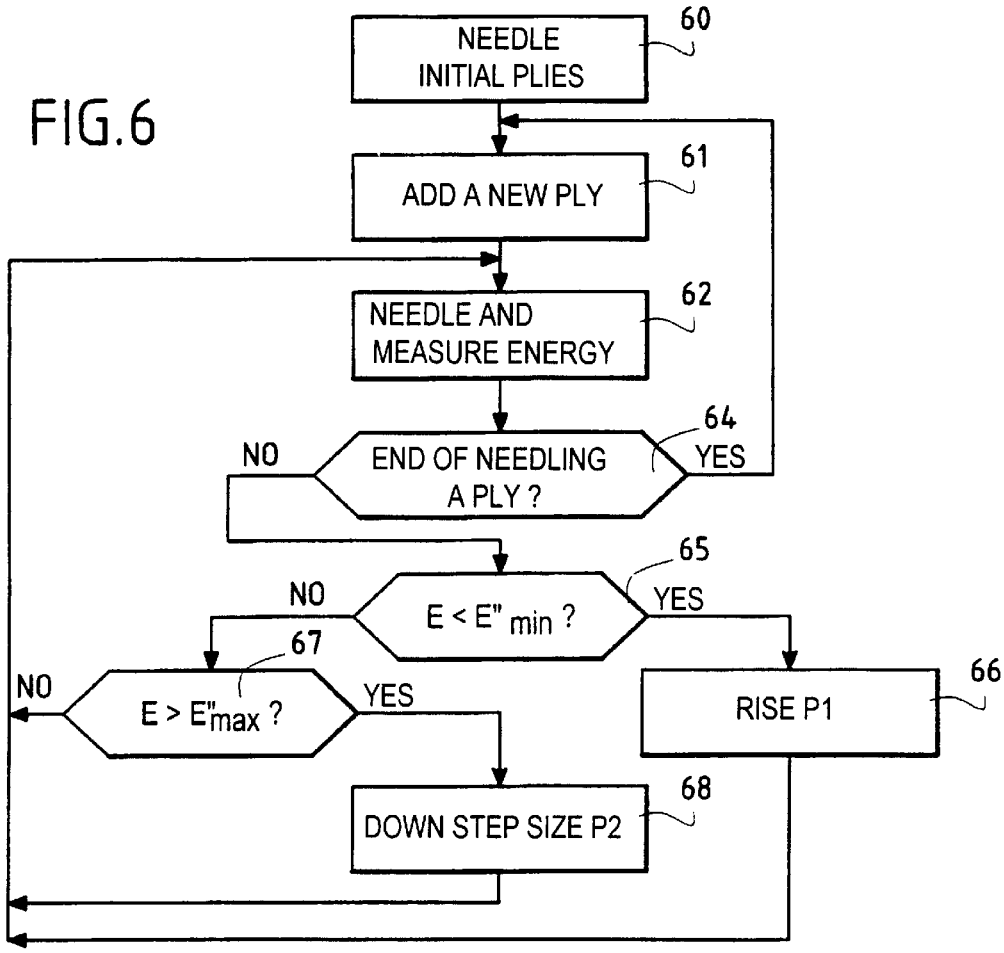

FIG. 6 shows the steps of a needling process in which the descent of the platen is controlled as a function solely of the evaluated needling energy.

After needling the initial plies (step 60) , a new ply is added (step 61), needling is started, and needle penetration energy E is evaluated (step 62) as in step 43 of FIG. 4. Insofar as the current needling pass has not terminated (test 64), the evaluated energy E is compared with a minimum threshold value $E''_{min}$ and a maximum threshold value $E''_{max}$, If the energy E is less than $E''_{min}$ (test 65), then the platen is caused to rise through an individual step P1 (step 66) and the process returns to step 62. If the outcome of step 64 is positive, then the process returns to step 61. If the energy E is not less than $E''_{min}$, it is compared with $E''_{max}$ (step 67). If the energy E is greater than $E''_{max}$, then the platen is caused to move down through an individual step P2 (step 67), and the process returns to step 62. If the energy E is not greater than $E''_{max}$, then the process returns to step 62.

The values $E''_{min}$ and $E''_{max}$ can be predefined experimentally as a function of the desired needling characteristics. They can be fixed or they can vary as the fiber plate is built up, so as to follow a predetermined variation relationship.

The up step $p_1$ and the down step $p_2$ can be equal to each other, or not equal. Their values can be fixed or variable, e.g. in predetermined manner as a function of the magnitude of the difference between E and $E''_{min}$ or between E and $E''_{max}$.

Naturally, the processes of FIGS. 4 to 6 are interrupted after the last needling pass has been performed, with the plate P then reaching its desired thickness.

Needling force measurement can be fitted not only to rectilinear needling apparatus, but also to circular needling apparatus.

Figure 7:
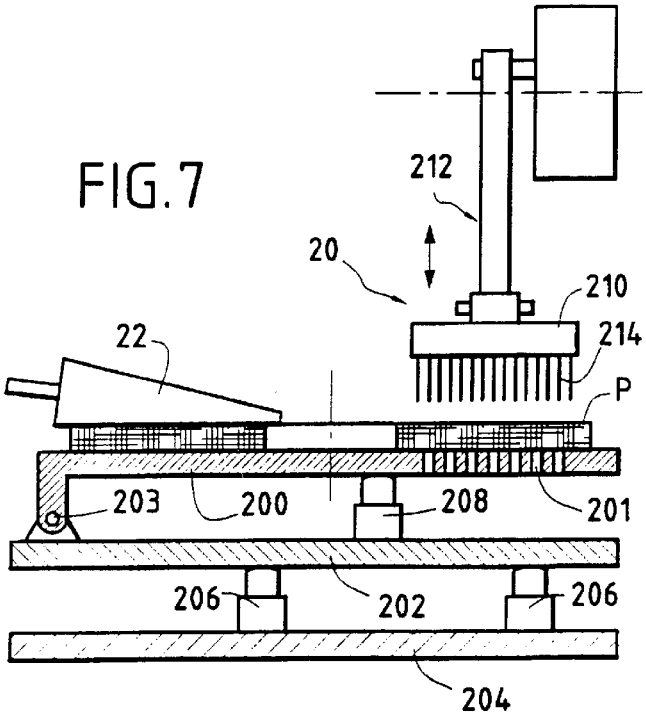
FIG. 7 is an elevation view of circular needling apparatus in accordance with the invention.
Figure 8:
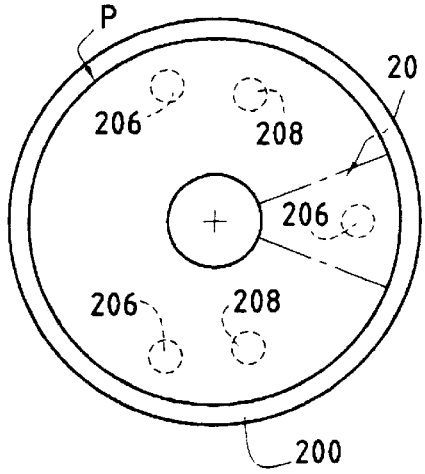
FIG. 8 is a plan view of the platen of the FIG. 7 needling apparatus.

Thus, FIGS. 7 and 8 show needling apparatus having a circular platen 200. Annular plies are stacked and needled on the platen 200 to form a needled fiber preform or disk P of annular shape. In conventional manner, the plies can be formed by rings or by juxtaposed annular sectors cut out from a two-dimensional fiber fabric, e.g. a woven cloth, a unidirectional or multidirectional sheet, a felt, . . . The plies can also be formed by turns that are wound flat, such as turns of helical cloth, or turns formed from deformed braids, or indeed turns formed from a deformable two-dimensional fabric. Reference can be made, for example, to the following documents: U.S. Pat. No. 6,009,605, U.S. Pat. No. 5,662,855, and WO 98/44182. The annular preform P can serve in particular as a preform for a brake disk of composite material.

The disk P is rotated and it passes through a needling station having a needle board 210 which overlies a sector of the platen 200 (whose location is defined by chain-dotted lines in FIG. 8). The board 210 is driven with reciprocating motion in vertical translation by means of a crank and connecting rod type drive device 212.

The needles 214 carried by the board 212 are provided with barbs, hooks, or forks for taking fibers from the stacked plies and transferring them through the plies when they penetrate into the disk P.

The disk P can be rotated by means of conical rollers such as 22, the platen 200 being stationary and being provided with holes 201 in register with the needles 214. In a variant, the disk P can be rotated by rotating the platen 200. In which case, the platen 200 is provided with a coating into which the needles can penetrate without being damaged. Transferring fibers in the Z direction into this coating thus secures the disk P to the platen and makes it easier to rotate the disk.

The platen 200 is hinged on a support 202 which rests on a support structure 204 via actuators 206, there being three such actuators in the example shown (see FIG. 8).

One or more force sensors 208, there being two such sensors in the example shown, are interposed between the support 202 and the platen 200.

As shown in FIG. 7, the hinge 203 between the platen 200 and the support 204 is situated in a circumferential zone of the platen 200 remote from the zone where the needling station 20 is to be found. The sensors 208 are situated beneath the platen 200 on either side of the needling zone 20, at locations that are far away from the hinge 203. This disposition of the hinge 203 and of the sensors 208 serves to optimize measurement of the needling force, with this measurement being performed at or in the needling station 20.

The signals from the sensors 208 are picked up by a control circuit which serves in particular to control rotation of the disk P and to control the actuators 206 so as to move the platen vertically during the needling process.

The signals from the sensors 208, representing the effectiveness of the needles when they penetrate into the disk P, and possibly also a measurement of the position of the top face of the disk P are used to monitor or control needling in real time, using processes such as those described with reference to FIGS. 4 to 6.

What is claimed is:

1. A method of making a needled fiber structure of the type comprising stacking fiber plies on a platen, needling the plies together as the stack is built up by means of needles that are driven with reciprocating motion in a direction that extends transversely relative to the plies, and varying the distance between the platen and an end-of-stroke position of the needles while building up the stack so as to obtain a desired distribution of needling characteristics through the thickness of the fiber structure, wherein the instantaneous force exerted during needle penetration is measured and a magnitude representing needling force or penetration energy is evaluated on the basis of the instantaneous force, and the evaluated magnitude is verified for compliance with at least one predetermined condition.

2. A method according to claim 1, wherein the needle penetration energy is evaluated by integrating the measured instantaneous force value.

3. A method according to claim 2, wherein integration is performed over the duration between the needles penetrating into the fiber structure and the needles reaching the bottom dead-center point of their stroke.

4. A method according to claim 1, wherein the evaluated magnitude is the maximum measured value of the instantaneous force.

5. A method according to claim 1, wherein the evaluated magnitude is verified for remaining substantially constant.

6. A method according to claim 1, wherein the evaluated magnitude is verified for substantially following a predetermined variation relationship.

7. A method according to claim 1, wherein the distance between the platen and an end-of-stroke position of the needles is varied as a function of the value of the valuated magnitude.

8. A method according to claim 7, wherein the distance between the platen and an end-of-stroke position of the needles is varied in predetermined manner during the needling process, and, where appropriate, an additional modification of said distance is superposed whenever the evaluated magnitude does not satisfy the predetermined condition.

9. A method according to claim 1, wherein the instantaneous force is measured via the platen.

10. Needling apparatus comprising a platen on which fiber plies can be stacked, a plurality of needles carried by a support above the platen, means for driving the needle support to impart reciprocating motion to the needles in a direction that extends transversely relative to the platen, and means for varying the distance between the platen and an end-of-stroke position of the needles, wherein at least one force sensor is provided suitable for providing a signal representative of the instantaneous force exerted during penetration of the needles into the fiber plies stacked on the platen.

11. Apparatus according to claim 10, including means for determining a maximum value of the instantaneous force during needle penetration.

12. Apparatus according to claim 10, including means for evaluating a magnitude representative of needle penetration energy by integrating the instantaneous force.

13. Apparatus according to claim 10, wherein at least one force sensor is interposed between the platen and a support structure.

14. Apparatus according to claim 10, wherein the platen is hinged at one of its edges and rests on at least one force sensor at a location that is remote from its hinge.

15. Apparatus according to claim 10, including means for detecting passage of the needles through at least one of the ends of their stroke.

16. Apparatus according to claim 10, including means for measuring the position of the top surface of the stacked fiber plies on the platen.

* * * * *